US006422888B1

(12) United States Patent
Goble

(10) Patent No.: US 6,422,888 B1
(45) Date of Patent: Jul. 23, 2002

(54) DAMAGE RESISTANT LATCHING ELECTRICAL CONNECTOR

(76) Inventor: Robert H. Goble, 10102 Blazed Tree Ct., Orlando, FL (US) 32821

( * ) Notice: Subject to any disclaimer, the term of this patent is extended or adjusted under 35 U.S.C. 154(b) by 0 days.

(21) Appl. No.: 09/905,140

(22) Filed: Jul. 16, 2001

(51) Int. Cl.[7] ..... H01R 13/64
(52) U.S. Cl. ..... 439/341; 439/376
(58) Field of Search ..... 439/376, 341, 439/157

(56) References Cited

U.S. PATENT DOCUMENTS

| | | | | |
|---|---|---|---|---|
| 3,171,704 A | * | 3/1965 | Meile | 439/341 |
| 3,984,169 A | | 10/1976 | Armstrong et al. | |
| 5,104,331 A | | 4/1992 | Goble | |
| 5,408,059 A | | 4/1995 | Goble | |
| 5,871,363 A | * | 2/1999 | Kimura | 439/157 |
| 5,876,225 A | * | 3/1999 | Katsuma et al. | 439/157 |
| 5,888,080 A | * | 3/1999 | Maejima | 439/157 |
| 6,095,833 A | * | 8/2000 | Osawa | 439/157 |

* cited by examiner

*Primary Examiner*—Renee Luebke
*Assistant Examiner*—Briggitte R. Hammond
(74) *Attorney, Agent, or Firm*—William M. Hobby, III

(57) ABSTRACT

A latching insulated electrical connector apparatus has a first electrically insulating housing having a plurality of abutting electrical insulating members mounted therein and having an electrical contact mounted between each pair of adjacent insulating members. The first housing has a hinge cutout therein. A second electrically insulating housing has an open end and a plurality of protruding electrical contacts mounted therein, each of which aligns with one of the electrical contacts mounted between each pair of insulating members. The second housing has a hinge pin attached thereto across said open end thereof and a pair of locking lugs thereon. The hinge pin is positioned to align with the first housing hinge cutout and one of the locking lugs. The hinge cutout is shaped to fit over the hinge pin and pair of locking lugs in one position and to lock the first and second housings together with the first housing electrical contacts operatively connected to the second housing protruding electrical contacts when rotated to a locking position so that an insulated electrical connector can rapidly connect at least two electrical conductors together.

6 Claims, 2 Drawing Sheets

DAMAGE RESISTANT LATCHING ELECTRICAL CONNECTOR

BACKGROUND OF THE INVENTION

This invention relates in general to electrical connectors and, more specifically, to latchable electrical connectors that are resistant to inadvertent separation and impact or crushing damage.

A wide variety of electrical connectors have been developed to connect electrical cables together and to connect cables to equipment. Several standard connectors have been developed for use with different voltage and current levels. Typically, these have several differently shaped and spaced prongs on one component that slip into correspondingly configured sockets on a second component. While effective in normal household use, these are less than fully effective in many applications and environments.

Where extensive use of extension cables is required, such as in the construction industry or in lighting motion picture or video sets, connectors may be subject to forces tending to pull them apart and to environmental conditions that can contaminate the connector or prongs with water or other materials. Also, these connectors are subject to damage to prongs when disconnected, such as by having prongs bent or damaged by persons stepping on them, being run over by vehicles and the like. When the prongs are contaminated or where the connector is not fully connected, intermittent short circuits between prongs or intermittent open circuits may occur, which are often very difficult to detect and repair. Further, partially inserted prongs may allow the circuit to function, but may allow metallic contamination to touch the prongs causing short circuits or even fires. There is even a possibility of electrocution where a person handling cables comes into contact with prongs that are not fully inserted, particularly on outdoor sites.

Attempts have been made to reduce these problems and dangers by knotting the cables together adjacent to the connection or apply clamping devices to hold the connection together. Knotted cables are cumbersome and provide projections over which people may trip and stumble. The clamps while sometimes effective, are also large and cumbersome and capable of failure if not properly used.

Many connectors are hollow and relatively fragile and subject to damage if subjected to impact or crushing, such as when construction material is dropped on a connector or it is run over by a vehicle.

A number of special connectors have been developed in attempts to overcome these problems. For example, the Armstrong et al. U.S. Pat. No. 3,984,169 discloses a complex keying arrangement in which one component is pivoted about a swivel pin to bring a coded arrangement of blades and slots into mesh to connect a cable to a power distribution panel. A separate latch mechanism is required to keep the unit connected. While useful in this special application, this arrangement has little utility in normal cable to cable or cable to outlet connections.

The Meile U.S. Pat. No. 3,171,704 discloses an electrical connector made up of a first hollow box having a concave surface at one end on which several electrical contacts are formed and a second hollow box having a thin extended finger having a convex surface corresponding to the concave first surface, with three complementary contacts on the convex surface. These two surfaces are pivoted into contact about a pin to make a connection that cannot be separated by a straight line pull. While effective for many purposes, this connector is undesirably fragile for use in difficult environments. For example, the boxes will be subject to breaking, cracking or crushing if stepped upon or run over by vehicles with hard wheels. The thin sleeve that covers the unit, when assembled, may crack and expose the pivoting hooks that are part of conductor system. The thin convex conductor member is liable to bend or break, causing at least intermittent loss of continuity and possible danger when used in a hazardous atmosphere.

In my prior U.S. Pat. No. 5,104,331 and No. 5,408,059 to Goble, I disclosed a damage resistant latching electrical connector for connecting a pair of electrical cables which includes a mechanism to prevent inadvertent disconnection. The present invention is an improvement over these prior patents in the means for locking the male and female components together and in the mounting for the electrical contacts within the housing and to facilitate assembly and repair.

Thus, there is a continuing need for improved electrical connectors for use in circumstances such as where a number of connected cables are connected across floors or roadways, such as in construction, lighting, or in emergency applications, such as natural disaster relief work Connectors are necessary that cannot be separated by straight line pull and will not be damaged or cause electrical hazards when subjected to abuse.

SUMMARY OF THE INVENTION

A latching insulated electrical connector apparatus has a first electrically insulating housing having a plurality of abutting electrical insulating members mounted therein and having an electrical contact mounted between each pair of adjacent insulating members. The first housing has a hinge cutout therein. A second electrically insulating housing has an open end and a plurality of protruding electrical contacts mounted therein, each of which aligns with one of the electrical contacts mounted between each pair of insulating members. The second housing has a hinge pin attached thereto across said open end thereof and a pair of locking lugs thereon. The hinge pin is positioned to align with the first housing hinge cutout and one of the locking lugs. The hinge cutout is shaped to fit over the hinge pin and pair of locking lugs in one position and to lock the first and second housings together with the first housing electrical contacts operatively connected to the second housing protruding electrical contacts when rotated to a locking position so that an insulated electrical connector can rapidly connect at least two electrical conductors together.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
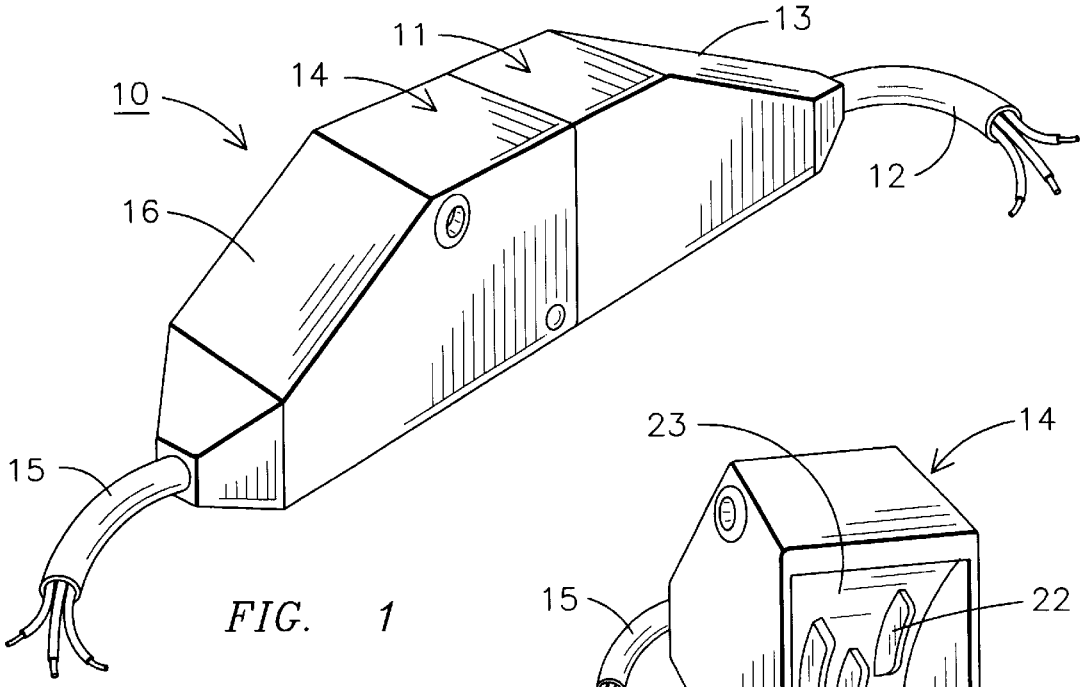
FIG. 1 is a perspective view of an electrical connector in accordance with the present invention.
Figure 2:
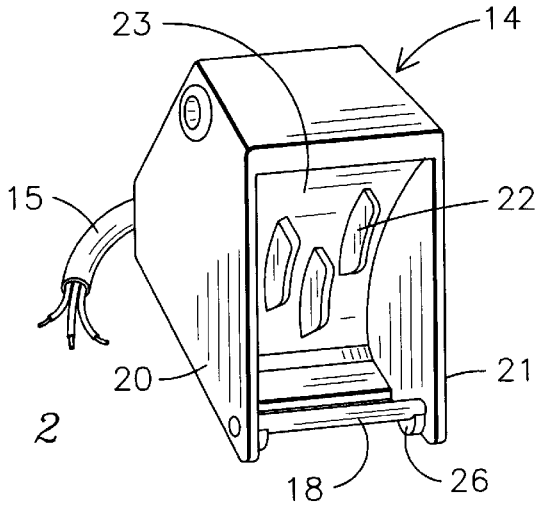
FIG. 2 is a perspective view of one of two connecting components of the electrical connector of FIG. 1.
Figure 3:
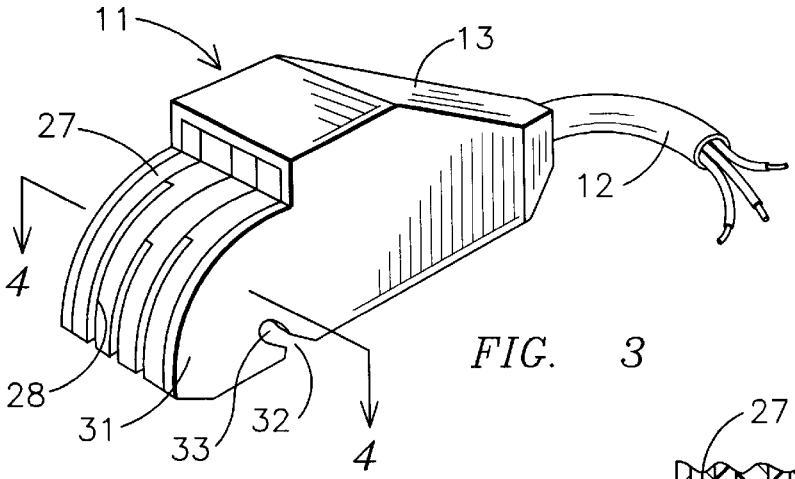
FIG. 3 is a perspective view of the other component of the electrical connector of FIG. 1.
Figure 4:
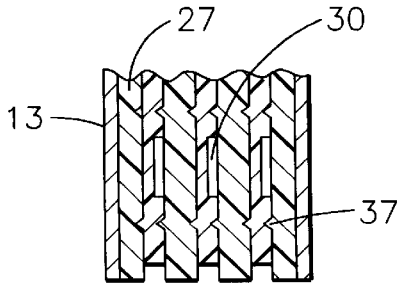
FIG. 4 is a sectional view taken on the line 4—4 of FIG. 3.

Referring to the drawings, FIGS. 1–8, an electrical connector 10 has a first electrical component 11 having a multi-strand electrical conductor 12 entering into a housing 13. A second electrical connector component 14 has a multi-strand electrical conductor 15 entering into a housing 16. The electrical component 14 having the housing 13, as seen in FIG. 2, has an open side 17 having a hinge pin 18 mounted between the sides 20 and 21. A plurality of electrical contacts 22 are mounted inside the housing and protrude from an insulation support 23. The contacts 22 are connected to the conductors 25 entering in the multiple conductor line 15 and are connected to the protruding electrical contacts 22 supported in the insulation block 23.

The hinge pin 18 has a pair of camming or locking lugs 26 attached thereto and mounted adjacent the sidewalls 20 and 21 of the component 14 housing 13.

Figure 5:
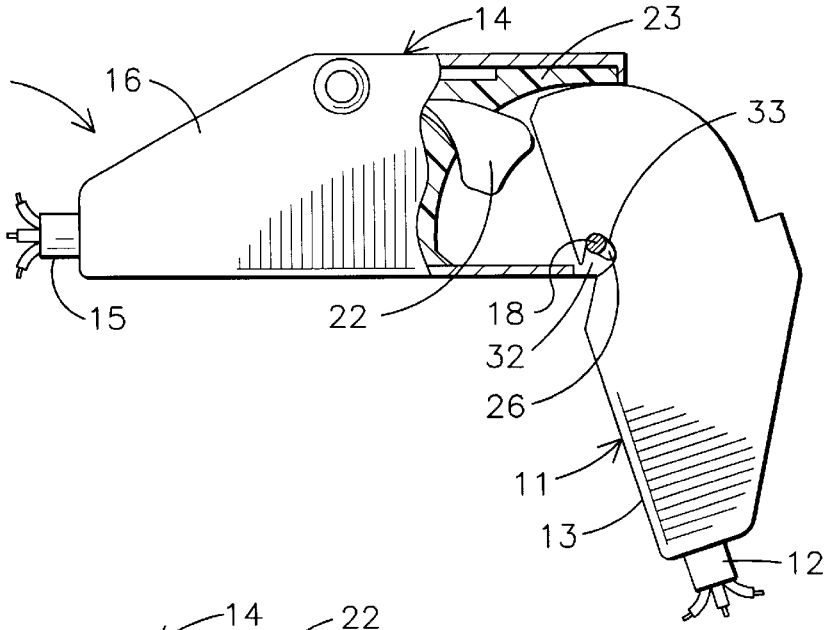
FIG. 5 is a cut away elevation of the electrical connector of FIG. 1 in an unlatched position.
Figure 6:
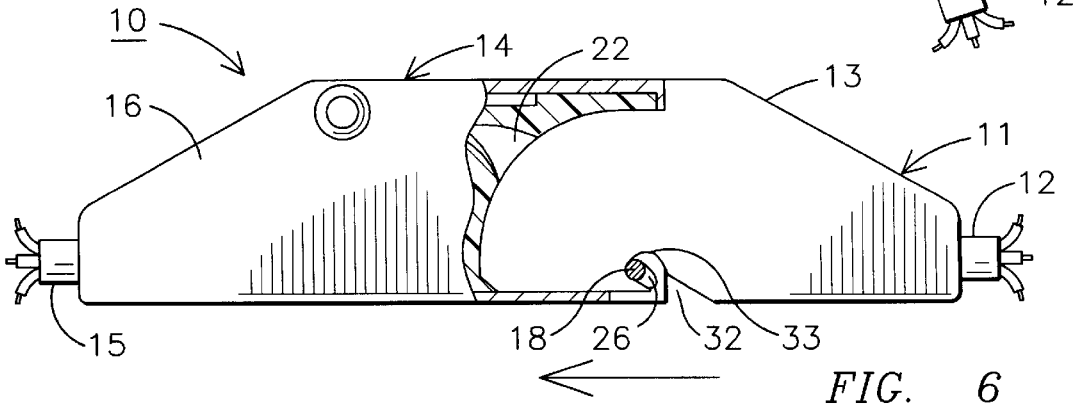
FIG. 6 is a cut away elevation of the electrical connector of FIG. 5 in a locked position.

The electrical connector component 11 having a housing 13 can be seen as having a plurality of abutting insulation members 27 having aligning members 37 thereon may be rigid polymer foam members. A cutout 28 in each abutting insulation member 27 is located between each of the two abutting insulating members 27. An electrical contact 30 is mounted between each two polymer insulated members in the cutout openings 28 so that when the connectors are connected, as shown in FIG. 1, the protruding contacts 22 of the component 14 will slide into the openings 28 and into contact with the electrical connectors 30. The use of a plurality of insulating members 27 having alignment members 37 allows for ease in manufacture of the electrical connector as well as for easy alignment of the protruding electrical contacts 22 with the recessed electrical contacts 30. The electrical component 11 has a pair of sidewalls 31 each having an angled cutout or slot 32 having an enlarged head portion 33 and sized to be slipped over the hinge pin 18 and locking lugs 26, as shown in FIG. 5, when positioned at an angle when locking the two components 11 and 14 together. Once the angled openings 32 engage the hinge pin, as seen in FIG. 5, the electrical connector component can be rotated, as shown in FIG. 6, to lock the components together. By having the edge of the slot 32 slide under the locking lugs 26 to bring the locking lug 26 into engagement therewith and to cam lock, as shown in FIG. 6. When the electrical component 11 is rotated from the position in FIG. 5 to the position in FIG. 6, the electrical contacts 22 slide into the openings 28 between the insulating plates 27 to make contact with the contacts 30. The housing 13 and 16 can be made of a metal, as illustrated, but can also be made of an insulating material to provide greater insulation to the connector. In addition, the mounting plate 23 and the plurality of plates 27 are made of an insulating material, such as a rigid foam polymer, which insulates the contacts as well as strengthens the electrical connector components 11 and 14 by strengthening the housings 13 and 16. In the last few degrees of rotation, cam 26 acting on slot 32 forces the two halves of the connector together forming a weatherproof seal.

Figure 7:
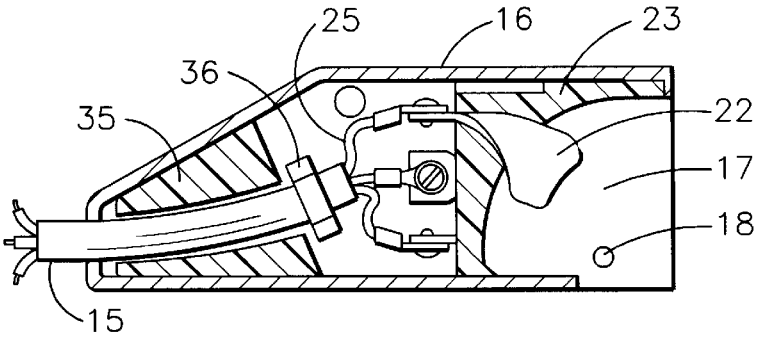
FIG. 7 is a sectional view taken through the connector component of FIG. 2.
Figure 8:
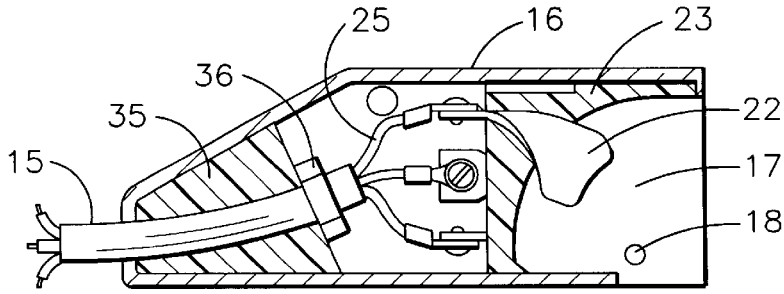
FIG. 8 is a sectional view taken through the electrical connector component of FIG. 2.

As seen in FIGS. 7 and 8, an insulating block 35 is mounted in the electrical connector component 14 housing 16 for supporting the electrical line 15 therethrough and has a locking component 36 which abuts the insulating block 35 to prevent stress on the conductors 25.

It should be clear at this time that an electrical connector has been provided which can latch two electrical conductors together and which is resistant to separation or impact damage and which forms a weatherproof seal. However, the present invention should not be considered as limited to the forms shown which are to be considered illustrative rather than restrictive.

I claim:

1. A latching insulated electrical connector comprising:

a first electrically insulating housing having a plurality of pairs of abutting electrical insulating members mounted therein and having an electrical contact mounted between each pair of adjacent insulating members, said first housing having a hinge cutout therein;

a second electrically insulating housing having an open end and having a plurality of protruding electrical contacts mounted therein, each of which is positioned for making contact with one of said electrical contacts mounted between each pair of insulating members, said second housing having a hinge pin attached thereto across said open end thereof and having a pair of locking lugs thereon, said hinge pin being positioned to align with said first housing hinge cutout and one of said locking lugs, and said hinge cutout being shaped to fit over said hinge pin and pair of locking lugs in one position and to lock said first and second housings together with said first housing electrical contacts operatively connected to said second housing protruding electrical contacts when rotated to a locking position whereby an insulated electrical connector can rapidly connect at least two electrical conductors together.

2. The latching insulated electrical connector in accordance with claim 1 in which said first electrically insulating housing is made of a polymer.

3. The latching insulated electrical connector in accordance with claim 2 in which said second electrically insulating housing is made of a polymer.

4. The latching insulated electrical connector in accordance with claim 1 in which each said locking lug is shaped to form a camming surface on said hinge pin.

5. The latching insulated electrical connector in accordance with claim 4 in which said first housing hinge cutout is a slanted slot having an enlarged end portion shaped to lock onto each said lugs when rotated into a locked position.

6. The latching insulated electrical connector in accordance with claim 5 in which each of said first housing plurality of adjacent insulating members has a cutout portion therein shaped for one second housing protruding electrical contact to slide therein for making contact with one said first housing electrical contact.

* * * * *